US008091994B2

(12) United States Patent
Kubo et al.

(10) Patent No.: US 8,091,994 B2
(45) Date of Patent: Jan. 10, 2012

(54) LIQUID DROPLET JETTING APPARATUS INCLUDING LIQUID TANK AND TWO HEADS CONNECTED IN SERIES

(75) Inventors: Tomoyuki Kubo, Nagoya (JP); Takaichiro Umeda, Nagoya (JP); Ryuji Kato, Aisai (JP); Hisaki Sakurai, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 434 days.

(21) Appl. No.: 12/324,363

(22) Filed: Nov. 26, 2008

(65) Prior Publication Data

US 2009/0141094 A1 Jun. 4, 2009

(30) Foreign Application Priority Data

Nov. 30, 2007 (JP) ..... 2007-309964

(51) Int. Cl.
*B41J 2/175* (2006.01)

(52) U.S. Cl. ..... 347/85; 347/42; 347/84

(58) Field of Classification Search ..... 347/85, 347/42

See application file for complete search history.

(56) References Cited

U.S. PATENT DOCUMENTS

| | | | | |
|---|---|---|---|---|
| 5,456,539 | A * | 10/1995 | Wright et al. | 400/82 |
| 5,688,057 | A * | 11/1997 | Wright et al. | 400/82 |
| 5,961,228 | A * | 10/1999 | Ward et al. | 400/120.16 |
| 6,024,441 | A | 2/2000 | Nishimoto | |
| 6,196,668 | B1 | 3/2001 | Bode | |
| 6,203,148 | B1 | 3/2001 | Kishida | |
| 6,312,094 | B1 | 11/2001 | Ito et al. | |
| 6,982,737 | B2 * | 1/2006 | Elko et al. | 347/171 |
| 7,178,908 | B2 | 2/2007 | Katayama | |
| 7,273,272 | B2 * | 9/2007 | Inoue | 347/85 |
| 7,780,261 | B2 * | 8/2010 | Berry et al. | 347/29 |
| 7,794,046 | B2 * | 9/2010 | Baker | 347/40 |
| 2002/0005872 | A1 * | 1/2002 | Goto et al. | 347/22 |
| 2002/0027584 | A1 | 3/2002 | Kamanaka et al. | |
| 2002/0113852 | A1 | 8/2002 | Kimura et al. | |
| 2002/0158954 | A1 | 10/2002 | Usui et al. | |
| 2003/0058307 | A1 | 3/2003 | Egushi et al. | |
| 2003/0202059 | A1 | 10/2003 | Kimura et al. | |
| 2003/0210309 | A1 | 11/2003 | Kimura et al. | |
| 2005/0073565 | A1 | 4/2005 | Silverbrook | |
| 2005/0078155 | A1 | 4/2005 | Campion et al. | |

(Continued)

FOREIGN PATENT DOCUMENTS

| | | |
|---|---|---|
| CN | 2931119 | 8/2007 |

(Continued)

*Primary Examiner* — Julian Huffman
*Assistant Examiner* — Sharon A Polk
(74) *Attorney, Agent, or Firm* — Frommer Lawrence & Haug, LLP

(57) ABSTRACT

A printer includes a first head in which first nozzles are formed, a second head in which second nozzles located at a higher position than the first nozzle are formed, and an ink cartridge positioned at a lower position than the first and second nozzles. Moreover, the first head is connected to the ink cartridge via a tube, and the second head is connected to the first head via a tube. Accordingly, the second head is connected to the ink cartridge via the first head. It is possible to shorten the tubes by connecting serially the ink cartridge and the two heads, and to prevent from breaking simultaneously a meniscus in the nozzles of both the heads located at different height positions.

13 Claims, 14 Drawing Sheets

U.S. PATENT DOCUMENTS

| | | | | |
|---|---|---|---|---|
| 2005/0179726 | A1 | 8/2005 | Egushi et al. | |
| 2006/0132559 | A1 | 6/2006 | Sueoka | |
| 2006/0197818 | A1* | 9/2006 | Takatsuka | 347/104 |
| 2006/0284914 | A1 | 12/2006 | Murakami et al. | |
| 2007/0222817 | A1* | 9/2007 | Kurita et al. | 347/40 |
| 2007/0285474 | A1* | 12/2007 | Murakami | 347/85 |
| 2008/0036825 | A1 | 2/2008 | Zhang | |
| 2009/0027449 | A1* | 1/2009 | Silva et al. | 347/47 |

FOREIGN PATENT DOCUMENTS

| | | |
|---|---|---|
| EP | 0 822 083 | 2/1998 |
| JP | 53-100237 | 9/1978 |
| JP | 1-120981 | 8/1989 |
| JP | 5330037 | 12/1993 |
| JP | 10-095129 | 4/1998 |
| JP | 10-244681 | 9/1998 |
| JP | 10-258510 | 9/1998 |
| JP | 11091130 | 4/1999 |
| JP | 2000-510780 | 8/2000 |
| JP | 2002-103641 | 4/2002 |
| JP | 2002-067350 | 3/2003 |
| JP | 2003-080711 | 3/2003 |
| JP | 2004-167839 | 6/2004 |
| JP | 2005-103758 | 4/2005 |
| JP | 2005-306016 | 11/2005 |
| JP | 2007-001035 | 1/2007 |
| JP | 2007-508168 | 4/2007 |
| JP | 2007-203528 | 8/2007 |
| JP | 2007-203641 | 8/2007 |
| WO | WO-0172522 | 10/2001 |

* cited by examiner

LIQUID DROPLET JETTING APPARATUS INCLUDING LIQUID TANK AND TWO HEADS CONNECTED IN SERIES

CROSS REFERENCE TO RELATED APPLICATION

The present application claims priority from Japanese Patent Application No. 2007-309964, filed on Nov. 30, 2007, the disclosure of which is incorporated herein by reference in its entirety.

BACKGROUND OF THE INVENTION

1. Field of the Invention

The present invention relates to a liquid droplet jetting apparatus which includes two liquid droplets jetting heads each having a plurality of nozzles through which the liquid droplets are jetted, a height-position of the nozzles in one head being different from that in the other head.

2. Description of the Related Art

An ink-jet printer which records an image and characters on a recording medium such as a printing paper, generally includes an ink-jet head (liquid droplets jetting head) having nozzles through which liquid droplets of an ink is jetted, and an ink cartridge (liquid tank, liquid storage container) which stores the ink to be used in the ink-jet head. The ink-jet head and the ink cartridge are normally connected by a tube made of a resin, and the ink stored in the ink cartridge is supplied to the ink-jet head via this tube.

Incidentally, in recent years, with an object of making it possible to improve a recording speed and a simultaneous two-face printing, it has been considered to provide a plurality of ink-jet heads which jet the same type (same color) of ink. Here, in a case of providing the plurality of ink cartridges corresponding to the plurality of ink-jet heads respectively, the number of cartridges is to be increased. Therefore, there is an increase in a cost and a size of the printer. From this point of view, it is preferable to make it possible to supply the ink from one ink cartridge to the plurality of ink-jet heads simultaneously.

In Japanese Patent Application Laid-open No. H10-95129, an ink cartridge provided with two ink supply ports has been disclosed. Moreover, the two ink supply ports in this ink cartridge are connected in parallel to the two ink-jet heads by two supply tubes. Therefore, it is possible to supply the ink from one ink cartridge to two ink-jet heads simultaneously.

SUMMARY OF THE INVENTION

Incidentally, in case of connecting individually (connecting in parallel) one ink cartridge and the plurality of ink-jet heads by the plurality of tubes, the total tube length becomes long, and it leads to an increase in the cost. Moreover, when the tube is made of a resin (material) and has some air permeability, there is a problem of gradual drying of the ink, which leads to an increase in a viscosity (thickening of ink). Or, there is a problem of entry of an air bubble into the tube from outside. Here, longer the total length of the tube, larger is an amount of the ink thickened inside the tube, and the amount of air bubbles entering into the tube is large. Therefore, when such ink including the thickened ink and air bubbles is supplied to the ink-jet head, there is a possibility of occurrence of a jetting defect in the nozzle. In view of this, the inventors of the present patent application have taken into consideration, connecting in series one ink cartridge and two or more ink-jet heads for shortening the total length of the tube.

However, in a printer which is capable of printing simultaneously an image etc. on both surfaces of a recording medium, a height-position of nozzles for jetting the liquid droplets (a height of liquid droplet jetting surface) differs in the two ink-jet heads. In such case, when these two ink-jet heads are connected in series (connected serially), there is a possibility that the following problem arises.

Normally, when the head is at a stand-by position in which no ink is being jetted, a meniscus is formed inside the nozzle due to a surface tension of the ink. A balance of the pressure between the ink inside the nozzle and an atmosphere is maintained by this meniscus. However, it is taken into consideration a case in which the meniscus inside the nozzle is broken by a factor such as a disturbance etc. in the ink-jet head having the liquid droplet jetting surface at a higher position out of the two ink-jet heads connected serially. In this case, the atmospheric pressure acts directly on the ink inside this ink-jet head, and the ink flow reversely (in a reverse direction) toward the ink-jet head having the liquid droplet jetting surface at a lower position, which is connected via a tube to the ink-jet head having the liquid droplet jetting surface at a higher position. Therefore, there is a rise in the pressure of the ink inside the ink-jet head having the liquid droplet jetting surface at a lower position, and the meniscus inside the nozzle breaks. As a result, a large amount of ink might leak out from both the ink-jet heads.

An object of the present invention is to provide a liquid droplet jetting apparatus in which it is possible to shorten a length of the tube by connecting serially the two heads and a liquid tank, and further it is possible to prevent from breaking simultaneously the meniscus in the nozzle of both the heads having a different height-position of nozzles.

According to an aspect of the present invention, there is provided a liquid droplet jetting apparatus which jets a droplet of a liquid onto an object, including:

a first head in which a first nozzle, through which the droplet of the liquid is jetted, is formed;

a second head in which a second nozzle, through which the droplet of the liquid is jetted and which is located at a higher position than the first nozzle, is formed;

a liquid tank which supplies the liquid to the first and second heads and which is located at a lower position than the first and second nozzles; and a plurality of tubes via which the first head, the second head and the liquid tank are connected, wherein the first head is connected to an end of one tube of the tubes, and the liquid tank is connected to the other end of the one tube, and the second head is connected to the first head via the one tube such that the second head is connected to the liquid tank via the first head.

According to the aspect of the present invention, the second head is connected to the liquid tank via the first head. In other words, the liquid tank and the first head and the second head are connected serially. Consequently, as compared to a case in which the liquid tank and the two heads are connected in parallel by two tubes, it is possible to shorten a total length of the tubes. Therefore, it is possible to reduce a cost of the tubes, and also to suppress a thickening of the liquid inside the tubes, and an entry of an air bubble into the tubes.

Out of the two heads connected in series to the liquid tank, the first head in which the nozzle for jetting the liquid droplet is formed at a lower position is arranged at a side of the liquid tank. Furthermore, the liquid tank is positioned at a lower position than the nozzle (the first nozzle) of the first head. In this case, when a meniscus in the nozzle in the second head at a higher position is broken, the liquid in the second head flows in a reverse direction, and flows to the first head at the lower position. However, since the liquid which has flowed from the second head to the first head further escapes to the liquid tank at a lower position than the first head, no substantial pressure is exerted on the liquid in the first nozzle of the first head, and the breaking of the meniscus in the first nozzle is prevented.

In the liquid droplet jetting apparatus of the present invention, the liquid tank may be connected to one end portion of the first head, and the second head may be connected to the other end portion of the first head.

In this case, the liquid is supplied from the liquid tank to the one end portion of the first head, and the liquid is supplied from the other end portion of the first head to the second head. Therefore, a flow of the liquid flowing from the one end portion to the other end portion is generated in the first head, and an air bubble hardly accumulates in the first head.

In the liquid droplet jetting apparatus of the present invention, each of the first nozzle and the second nozzle may include a plurality of nozzles, and each of the first and second head may be a fixed-type line head in which a nozzle row including the plurality of nozzles arranged in a predetermined direction is formed, and which jets the droplet of the liquid while the fixed-type line head is positioned and fixed at a predetermined position.

In this case, in the fixed-type line head which jets the liquid droplet from the nozzles while the line head is positioned and fixed at the predetermined position, since the head does not move, it is not possible to supplement a nozzle in which a jetting defect occurs, by other normal nozzles, and it is necessary to carry out a purge from the nozzle for eliminating the jetting defect. However, generally, since the number of nozzles in the fixed-type line head tend to be substantially larger as compared to the number of nozzles in a serial head, when the purge is carried out to eliminate the jetting defect, an amount of liquid which is discharged is extremely larger than an amount of the liquid discharged in the serial head. In this manner, as compared to the serial head, the fixed-type line head can be said to have a substantial effect when there is a thickening of liquid or a mixing of an air bubble. Therefore, for a structure having the head of the fixed line type, it is possible to suppress the thickening of the liquid and the entry of an air bubble by shortening the total length of the tube, and an application of the present invention is extremely effective.

The liquid droplet jetting apparatus of the present invention may further include a transporting mechanism which transports the object, between the first head and the second head, and the droplet of the liquid through the first nozzle and the droplet of the liquid through the second nozzle may be jetted onto a front surface and a rear surface of the object, respectively, which is transported by the transporting mechanism.

In the liquid droplet jetting apparatus of the present invention, the first head may be arranged such that the first nozzle is open upwardly, and the second head may be arranged such that the second nozzle is open downwardly, and the liquid droplet jetting apparatus may further include a transporting mechanism which transports the object along a transporting path which is located at a position above the first head, and at a position below the second head. Furthermore, the first head and the second head may be arranged to face with each other.

In any of these cases, since the first nozzle of the first head and the second nozzle of the second head are at different positions in a vertical direction, it is possible to make jet the liquid droplets from the first nozzle and the second nozzle, on both the surfaces (a front surface facing the first nozzle and a rear surface facing the second nozzle) of the object which is transported between the first head and the second head by the transporting mechanism. For instance, when the object is in the form of a sheet such as a recording paper, two-sided printing is possible. Moreover, when the first head and the second head are arranged to face with each other, it is possible to make small a space in the liquid droplet jetting apparatus, in which the heads are accommodated, and to make the liquid droplet jetting apparatus small.

The liquid droplet jetting apparatus of the present invention may further include a purge mechanism including a first cap which covers the first nozzle of the first head, a second cap which covers the second nozzle of the second head, a cap driving mechanism which drives the first and second caps to move the first and second caps detachably toward a first nozzle surface in which the first nozzle is formed and a second nozzle surface in which the second nozzle is formed, respectively, and a suction mechanism which is connected to the first cap and the second cap and which performs suction for a space defined by the first cap and the first nozzle surface and a space defined by the second cap and the second nozzle surface. In this case, it is possible to carry out a purge process for a nozzle in which a jetting defect has occurred due to a thickened liquid or an air bubble, and it is possible to recover jetting characteristic of the nozzle.

In the liquid droplet jetting apparatus of the present invention, the suction mechanism may include a suction pump and a switch which switches a connection point of the suction pump between the space defined by the first cap and the first nozzle surface and the space defined by the second cap and the second nozzle surface. In this case, for example, when a jetting defect has occurred in one of the first head and the second head, it is possible to carry out the purge process only for one head, and it is possible to prevent a wasteful consumption of liquid droplets. Moreover, in that case, since it is possible to use one suction pump by switching between the two heads, it is not necessary to prepare the same number of suction pumps as the number of heads, and it is possible to make small the liquid droplet jetting apparatus.

In the liquid droplet jetting apparatus of the present invention, the first head and the second head may be arranged such that the first nozzle and the second nozzle are open downwardly, and the liquid droplet jetting apparatus may further include a transporting mechanism which transports the object along a transporting path which is inclined from a position below the first head to another position below the second head. In this case, it is possible to apply the present invention to a liquid droplet jetting apparatus which jets liquid droplets onto one surface of the object. For example, it is possible to apply the present invention to an ink-jet printer for single-sided printing which prints at a high speed by using two heads.

In the liquid droplet jetting apparatus of the present invention, the liquid tank may include a main tank which stores the liquid to be supplied to the first head and the second head, and a sub tank which is arranged between the main tank and the first head and which stores temporarily the liquid to be supplied to the first head and the second head. In this case, since the sub tank is provided between the main tank and the first head, it is possible to prevent an air bubble etc. which was mixed at the time of replacing the main tank, from reaching the heads.

In the liquid droplet jetting apparatus of the present invention, the sub tank may be arranged at a position higher than the main tank. In this case, since no water head pressure from the liquid in the main tank is exerted on the liquid in the sub tank, when the liquid has flowed reversely from the first head and the second head to the sub tank, it is possible to let the liquid flowed reversely, escape to the main tank.

In the liquid droplet jetting apparatus of the present invention, one of the first head and the second head may be a serial head which jets the droplet of the liquid onto the object while reciprocating in a predetermined direction.

In this case, since at least one of the first head and the second head is/are a so-called serial head which jets the liquid droplets while reciprocating along a predetermined scanning direction, when there occurs a jetting defect in a certain nozzle due to the thickening of the liquid in the tubes or an entry of an air bubble into the tubes, it is possible to supplement the nozzle in which the jetting defect has occurred, by controlling a jetting timing of the other nozzles with no jetting defect or by controlling a scanning speed of the heads. Moreover, since it is also possible to make smaller comparatively the number of nozzles of the serial head, even when a purge process of discharging the thickened liquid or an air bubble from the nozzle is carried out for eliminating the jetting defect, the small amount of ink discharged from the nozzle at the time of purge serves the purpose.

In the liquid droplet jetting apparatus of the present invention, the liquid may be an ink, and each of the first and second head may be a piezoelectric type ink-jet head which jets a droplet of the ink onto the object.

According to the present invention, since the liquid tank and the two heads are connected in series, it is possible to shorten the total length of the tube as compared to a case in which the liquid tank and each of the two heads are connected by two tubes (connected in parallel). Therefore, it is possible to reduce the cost of the tubes, and moreover it is possible to suppress the thickening of the liquid in the tubes and the entry of an air bubble into the tubes.

In addition to this, in the second head in which the nozzle is positioned at a position higher than in the first head, when the meniscus in the nozzle is broken, since it is possible to let the liquid which has flowed reversely from the second head, escape to the liquid tank, no substantial pressure is exerted on the liquid in the first nozzle of the first head, and the breaking of the meniscus in the first nozzle is prevented.

DETAILED DESCRIPTION OF THE PREFERRED EMBODIMENTS

An embodiment of the present invention will be described below. The embodiment described below is an example in which the present invention is applied to a simultaneous two-sided printer which is capable of printing simultaneously an image etc. on both surfaces of a printing paper.

Figure 1:
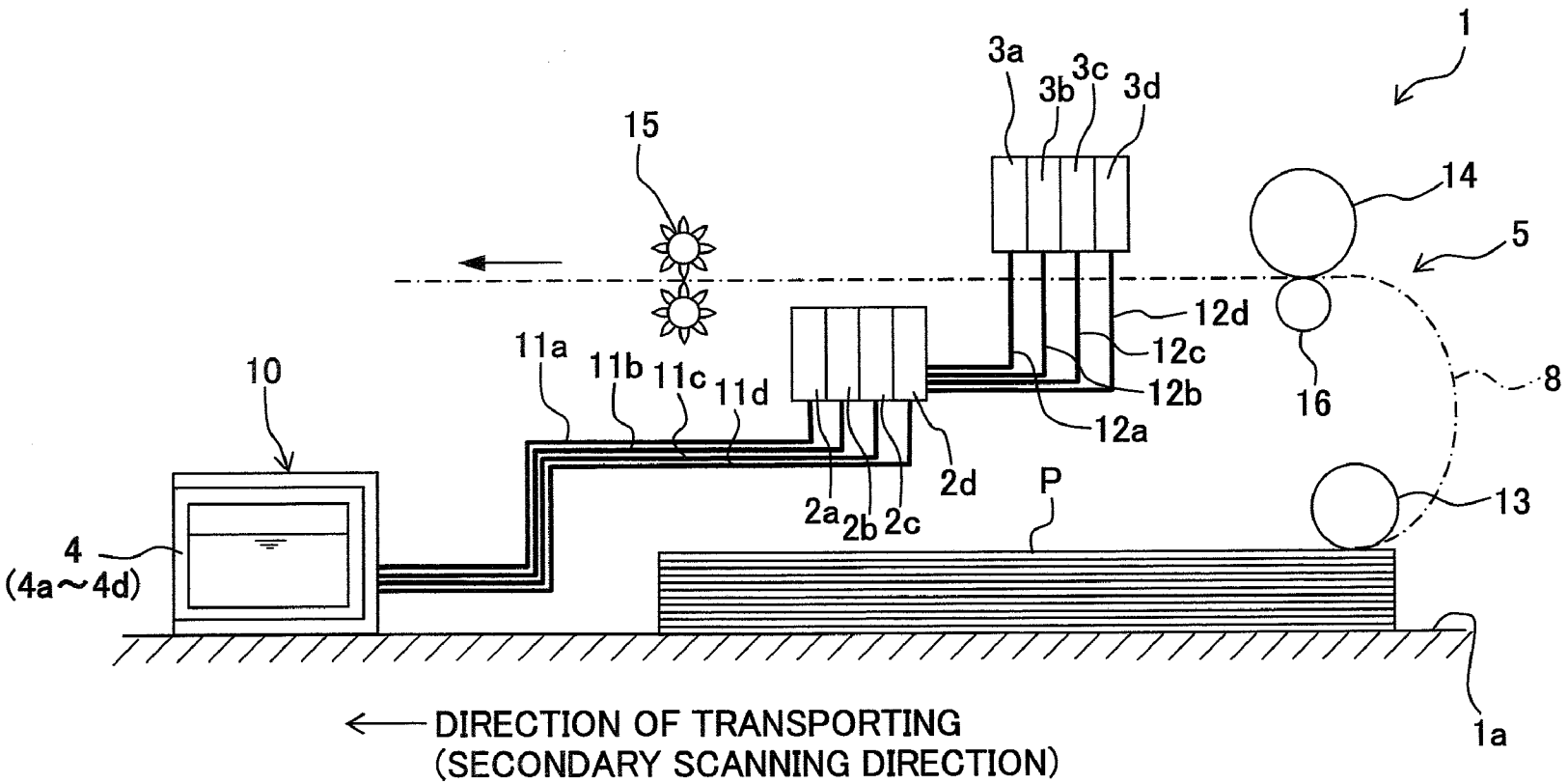
FIG. 1 is a side view showing a schematic structure of a printer according to an embodiment of the present invention.
Figure 2:
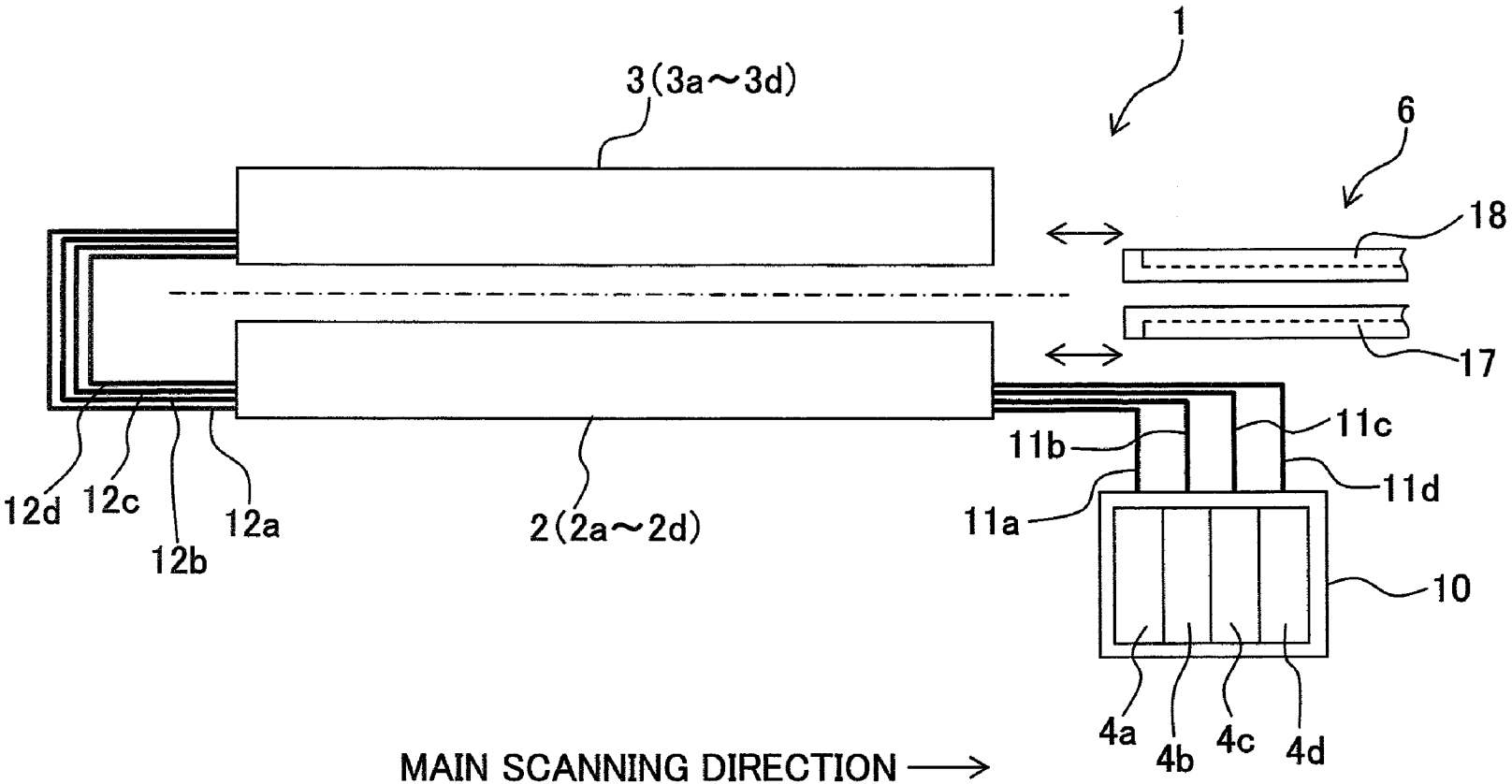
FIG. 2 is a front view of the printer in FIG. 1.

FIG. 1 is a schematic side view of a printer 1 of the embodiment, and FIG. 2 is a front view of the printer 1 in FIG. 1 (a diagram as viewed from a downstream side (left side in FIG. 1) of a transporting direction of the paper). In FIG. 2, a spur roller 15 shown in FIG. 1 is omitted.

As shown in FIGS. 1 and 2, the printer 1 (liquid droplet jetting apparatus) of the embodiment includes four first heads 2*a*, 2*b*, 2*c*, and 2*d* (first liquid droplet jetting heads), four second heads 3*a*, 3*b*, 3*c*, and 3*d* (second liquid droplet jetting heads) which are arranged at an upper side of the four first heads 2*a* to 2*d*, four ink cartridges 4*a*, 4*b*, 4*c*, and 4*d* (liquid storage containers, liquid tank) which store inks of four types (four color inks) respectively, a paper transporting mechanism 5 (transporting mechanism) which transports a printing paper P (recording medium) along a paper transporting path 8 (shown by alternate long and short dash lines in FIG. 1) between the first heads 2 and the second heads 3, a maintenance mechanism 6 which carries out maintenance of the first heads 2 and the second heads 3, and a control unit 7 (refer to FIG. 7) which controls the printer 1 entirely. In a case of designating collectively without distinction of the four ink cartridges 4*a* to 4*d*, they are designated as the ink cartridges 4. Similarly, the four first heads 2*a* to 2*d*, and the four second heads 3*a* to 3*d*, are designated as the first heads 2, and the second heads 3 respectively.

Both the first heads 2 and the second heads 3 are fixed line heads. In other words, each of the first heads 2 and each of the second heads 3 have a nozzle row including a plurality of nozzles 55 (first nozzles 55*a* and second nozzles 55*b*: refer to FIG. 9 and FIG. 10) arranged along a width direction of the paper (main scanning direction: a direction perpendicular to a paper surface in FIG. 1, and left-right direction in FIG. 2). The width direction is orthogonal to the transporting direction of the printing paper P. When the first heads 2 and the second head 3 are positioned and fixed at a predetermined position, the liquid droplets are jetted from the nozzles 55. Moreover, the four first heads 2*a* to 2*d* and the four second heads 3*a* to 3*d* are aligned in the transporting direction of the paper (secondary scanning direction: left-right direction in FIG. 1). Moreover, the four first heads 2*a* to 2*d* and the four second heads 3*a* to 3*d* jet inks of four colors namely yellow, magenta, cyan, and black respectively, from the respective nozzles 55.

On an upper surface (a liquid droplet jetting surface, a first nozzle surface) of the first heads 2, jetting ports of the nozzles 55 (first nozzles 55*a*) are arranged. Whereas, on a lower surface (a liquid droplet jetting surface, a second nozzle surface) of the second head 3, jetting ports of the nozzles 55 (second nozzles 55*b*) are arranged. Liquid droplets are jetted, from the first nozzles 55*a* of the first heads 2 and the second nozzles 55*b* of the second heads 3, onto both faces of the printing paper P transported along the paper transporting path 8 provided between the two heads 2, 3. Accordingly, the printer 1 is capable of printing simultaneously an image etc. on both surfaces of the printing paper P, that is, the printer 1 is a simultaneous two-sided printer.

The inks of four colors namely the yellow, magenta, cyan, and black are stored in the four ink cartridges 4*a* to 4*d*, and these four ink cartridges 4*a* to 4*d* are detachably mounted on a holder 10. Moreover, the holder 10 is fixed on a bottom surface 1*a* of a printer body, and is arranged on a lower side of the four first heads 2 and the four second heads 3. In other words, when the ink cartridges 4 are mounted on the holder 10, the ink cartridges 4 is always located at a position on a lower side of the jetting ports of the first nozzles 55*a* arranged on the upper surface (liquid droplet jetting surface) of the first head 2 and the jetting ports of the second nozzles 55*b* arranged on the lower side (liquid droplet jetting surface) of the second head 3.

Moreover, the four ink cartridges 4*a* to 4*d* and the four first heads 2*a* to 2*d* positioned at a higher position than the ink cartridges 4 are directly connected by four flexible tubes 11*a* to 11*d* made of a synthetic resin material, respectively. Furthermore, the four first heads 2*a* to 2*d* and the four second heads 3*a* to 3*d* arranged at a higher position than the first heads 2*a* to 2*d* are connected by four flexible tubes 12*a* to 12*d* made of a synthetic resin material, respectively. In other words, the second heads 3 on the upper side are connected to the ink cartridges 4 via the first heads 2 on the lower side. Furthermore, in other words, regarding one type of ink, one of the ink cartridges 4 which stores that ink, and one of the first heads 2 and one of the second heads 3 which use that ink are connected serially in order from below, in order of the ink cartridges 4, the first heads 2, and the second heads 3.

The paper transporting mechanism 5, which transports the recording paper P along the paper transporting path 8, includes a paper feeding roller 13, a main roller 14, a spur roller 15, and drive motors 82, 83, and 84 (refer to FIG. 12) which drive the paper feeding roller 13, the main roller 14, and the spur roller 15 respectively. In other words, the paper feeding roller 13 picks up one printing paper from the plurality of sheets of the stacked printing paper P, and the main roller 14 and a pressing roller 16 transport the printing paper P into the gap between the first head 2 and the second head 3. Further, the first head 2 and the second head 3 print an image on both sides of the printing paper P which is transported, and the printing paper P having an image etc. printed on both faces thereof is discharged by the spur roller 15.

Figure 3:
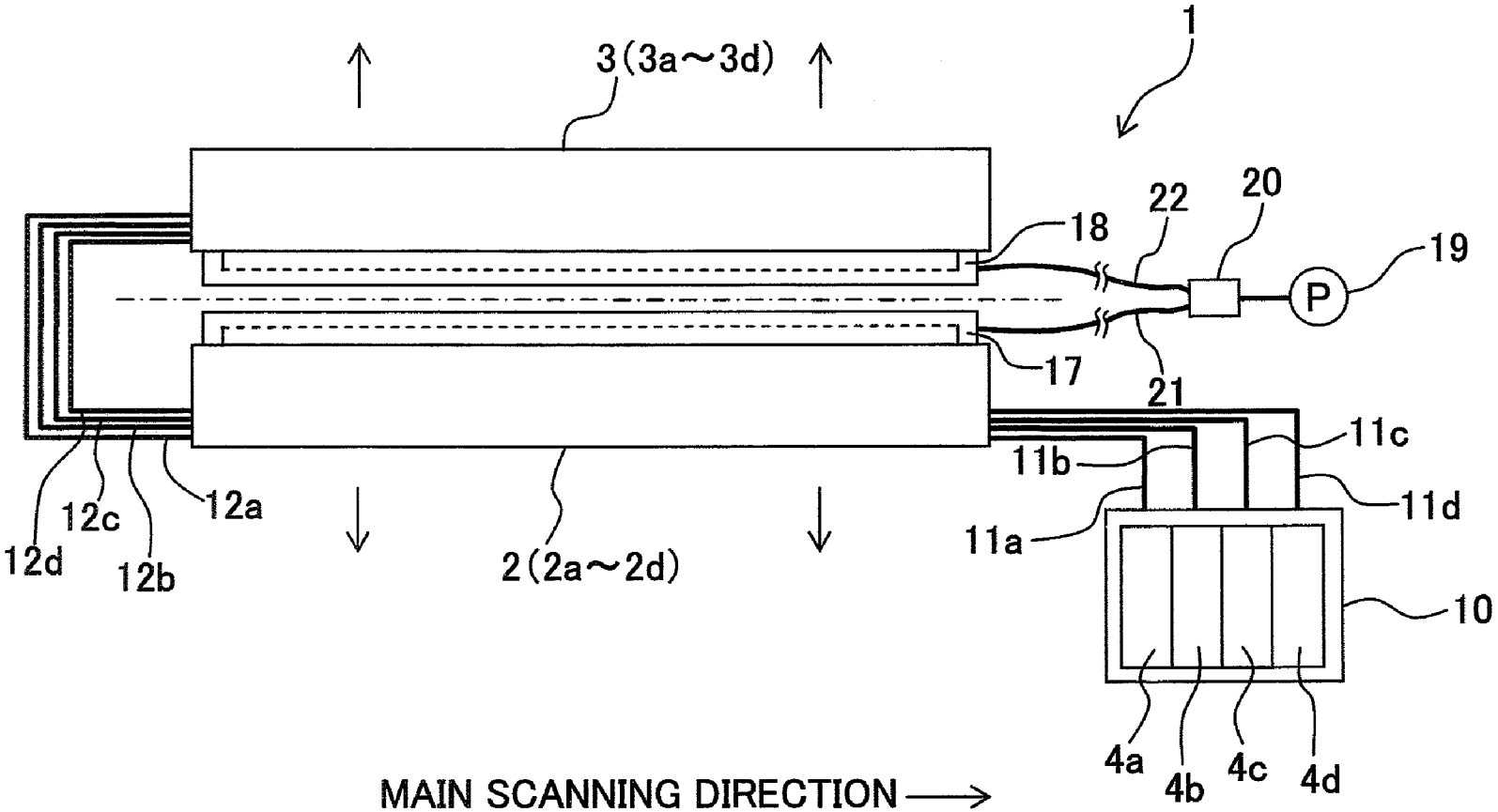
FIG. 3 is a front view of the printer at the time of suction purge.

The maintenance mechanism 6 is capable of carrying out a suction purge in which thickened ink, an air bubble, dust or the like is discharged from the nozzle 55 with the ink for restoring a liquid droplet jetting function of the first heads 2 and the second heads 3. FIG. 3 is a diagram showing the printer 1 when the suction purge is being carried out by the maintenance mechanism 6. As shown in FIGS. 2 and 3, the maintenance mechanism 6 includes a first cap 17 corresponding to the first heads 2, a second cap 18 corresponding to the second heads 3, and a suction pump 19 which is connected to each of the first cap 17 and the second cap 18

The first cap 17 and the second cap 18 are elongated in the width direction of a paper (main scanning direction). When the suction purge of the first heads 2 and the second heads 3 is not being carried out, the first cap 17 and the second cap 18 are in a stand-by state in which the first and second caps 17, 18 are located in an area at an outer side of the paper transporting path 8 in the width direction (main scanning direction) as shown in FIG. 2.

Figure 12:
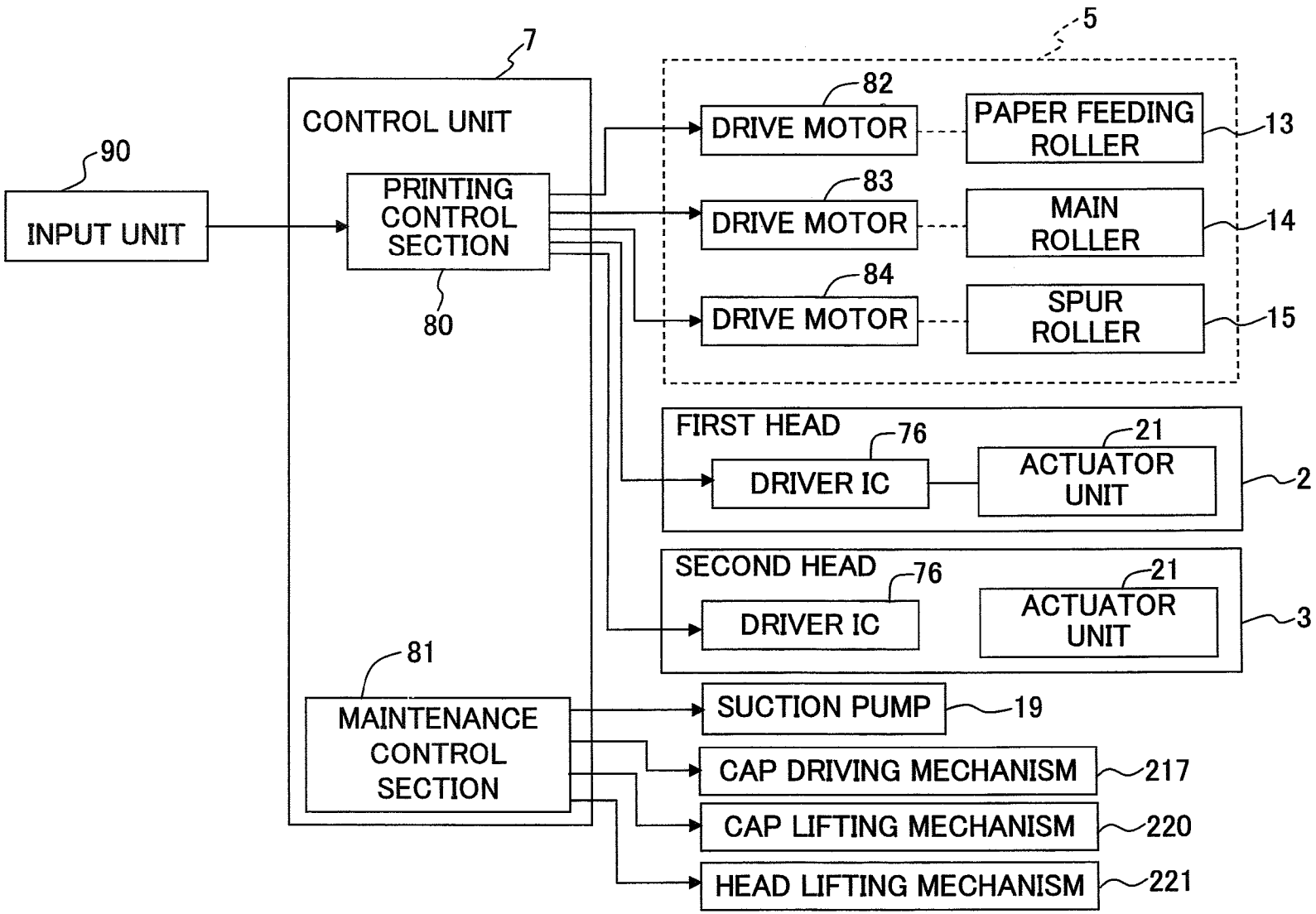
FIG. 12 is a block diagram showing schematically an electrical structure of the printer.

Moreover, both the first heads 2 and the second heads 3 are driven between a jetting-position of jetting the ink (a position in FIG. 2) and a maintenance position which is separated vertically, away from the paper transporting path 8, from the jetting position (a position in FIG. 3), by a lifting mechanism (a cap lifting mechanism 220) shown in FIG. 12. Furthermore, at the time of carrying out the suction purge of the first heads 2 and the second heads 3, the first heads 2 and the second heads 3 are driven from the jetting position to the maintenance position by the head lifting mechanism 221 (see FIG. 12). Thereafter, as shown in FIG. 3, the first cap 17 and the second cap 18 are driven from a stand-by position in FIG. 2 up to a position of the paper transporting path 8 by a cap driving mechanism 217 (see FIG. 12). Accordingly, the upper surface of the first heads 2 which is the liquid droplet jetting surface is covered by the first cap 17, and the lower surface of the second head 3 which is the liquid droplet jetting surface is covered by the second cap 18.

The first cap 17 and the second cap 18 are connected to a switching unit 20 by two tubes 21 and 22, and further, the switching unit 20 is connected to the suction pump 19. Moreover, a connection point (an access point) of the suction pump 19 is switched between the first cap 17 and the second cap 18 by the switching unit 20. Consequently, when the suction pump 19 is connected to the first cap 17, the ink from the nozzles (the first nozzles 55*a*) of the first heads 2 is sucked by the suction pump 19, and the suction purge of the first heads 2 is carried out. On the other hand, when the suction pump is connected to the second cap 18, the ink from the nozzles (the second nozzles 55*b*) of the second head 3 is sucked by the suction pump 19, and the suction purge of the second head 3 is carried out.

Figure 4:
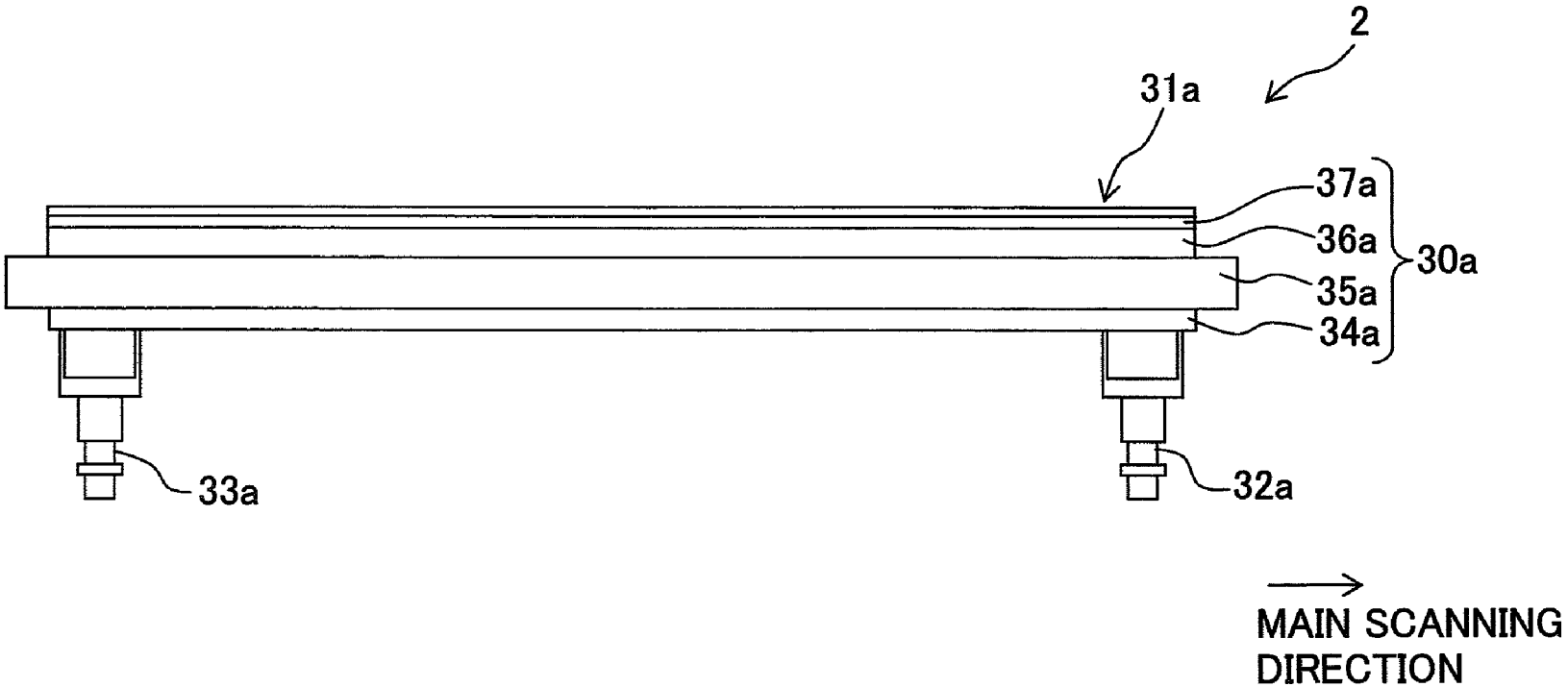
FIG. 4 is a front view of a first head.

Next, a structure of the first heads 2 and the second heads 3 will be described below in detail. A structure of the four first heads 2*a* to 2*d* is the same, and a structure of the four second heads 3*a* to 3*d* is also the same. One of the first heads 2 and one of the second heads 3 will be described below. FIG. 4 is a front view of the one of the first heads 2, FIG. 5 is a vertical cross-sectional view of the one of the first heads 2 in FIG. 4, FIG. 6 is a front view of the one of the second heads 3, and FIG. 6 is a vertical cross-sectional view of the one of the second heads 3 in FIG. 6.

Figure 5:
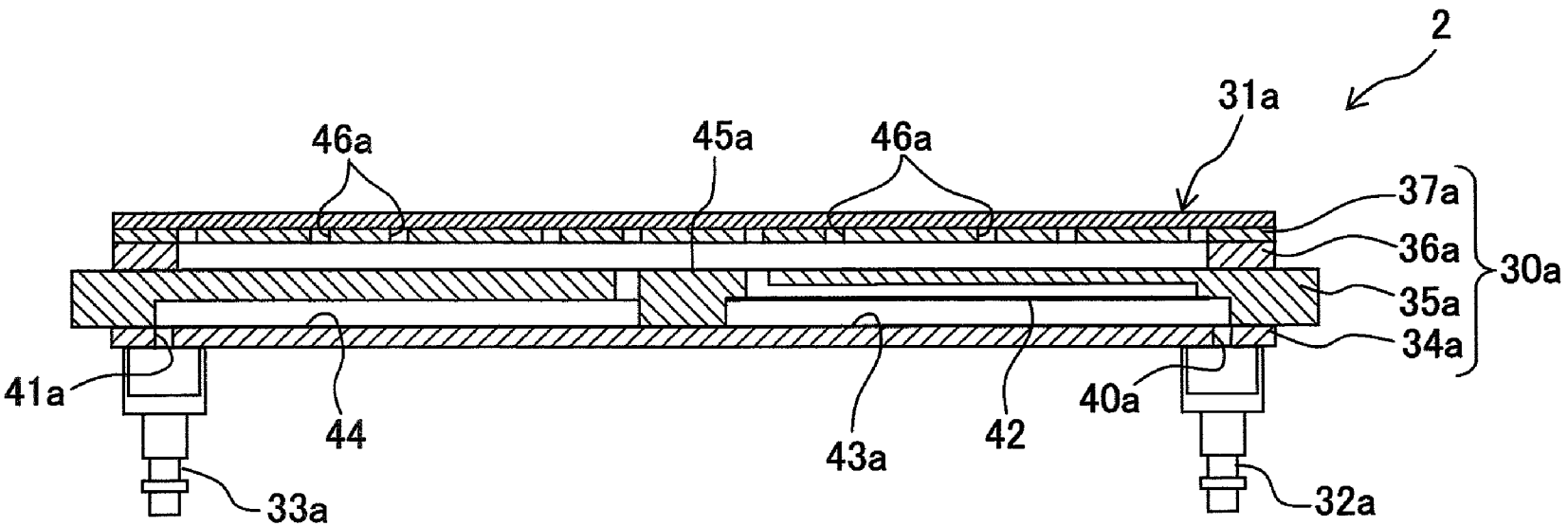
FIG. 5 is a vertical cross-sectional view of the first head in FIG. 4.
Figure 6:
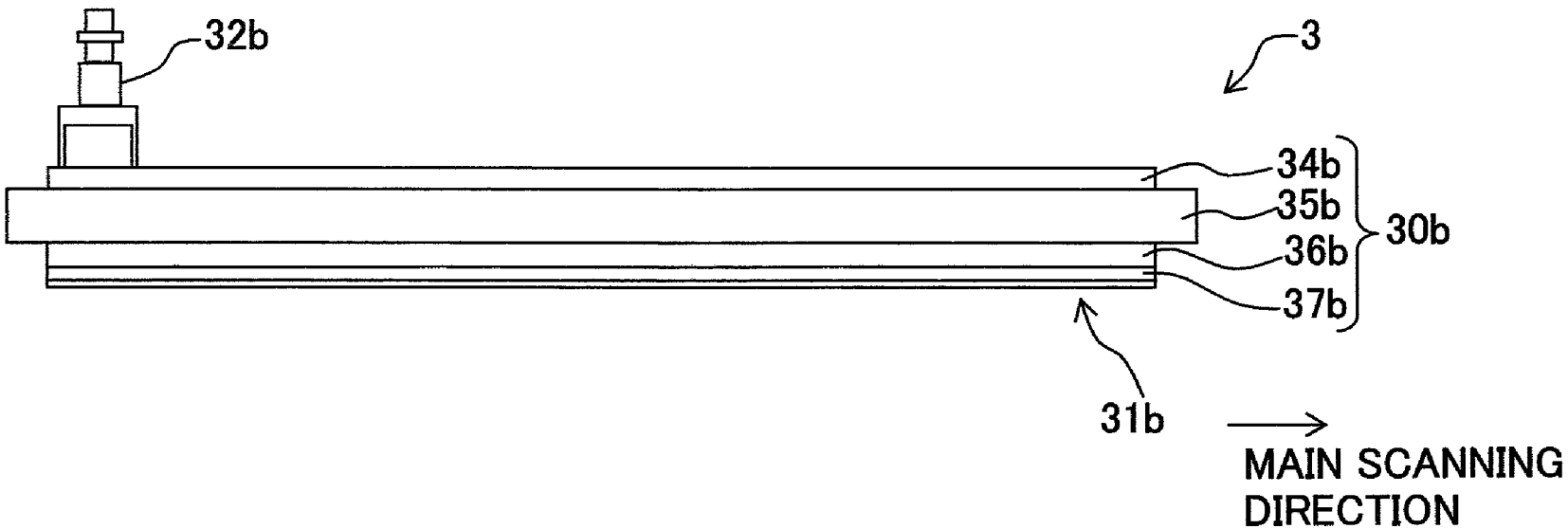
FIG. 6 is a front view of a second head.
Figure 7:
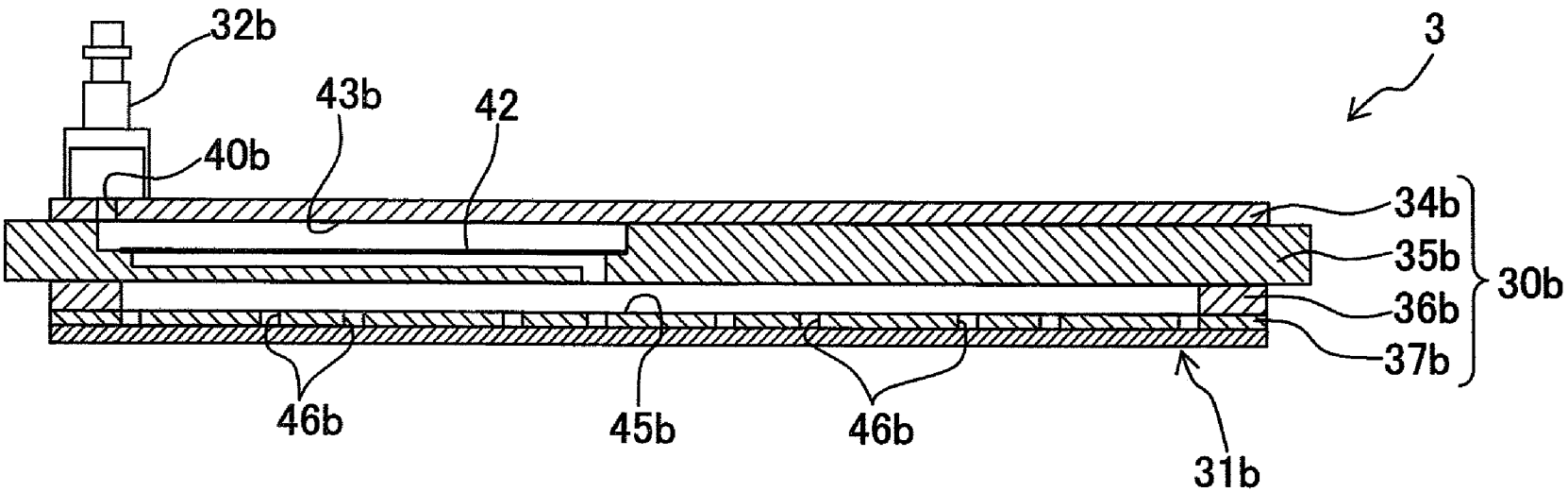
FIG. 7 is a vertical cross-sectional view of the second head in FIG. 6.

As shown in FIGS. 4 and 5, each of the first heads 2 includes a first reservoir unit 30*a* having an ink inlet portion 32*a* and an ink outlet portion 33*a*, and a head body 31*a* in which the nozzles 55 (the first nozzles 55*a*: refer to FIG. 9 and FIG. 10) are formed. The headbody 31*a* is joined to an upper surface of the first reservoir unit 30*a*. On the other hand, as shown in FIGS. 6 and 7, each of the second heads 3 includes a second reservoir unit 30*b* having an ink inlet portion 32*b*, and a head body 31*b* in which the nozzles 55 (the second nozzles 55*a*: refer to FIG. 9 and FIG. 10) are formed. The head body 31*b* is joined to a lower surface of the second reservoir unit 30*b*.

A structure of the first reservoir unit 30*a* and a structure of the second reservoir unit 30*b* defer slightly according to whether or not it includes the ink outlet portion 33*a*. Whereas, the head body 31*a* of the first heads 2 and the head body 31*b* of the second heads 3 are directed in opposite direction vertically, but the structures of both head body 31*a*, 31*b* are the same.

Firstly, the first reservoir unit 30*a* and the second reservoir unit 30*b* will be described below. As shown in FIGS. 4 and 5, the first reservoir unit 30*a* of the first head 2 is a stacked body of four plates 34*a*, 35*a*, 36*a*, and 37*a* each of which is elongated in the width direction of the paper (main scanning direction). The ink inlet portion 32*a* and the ink outlet portion 33*a* are provided at both end portions in a longitudinal direction of the lowermost plate 34*a*. The ink inlet portion 32*a* is connected to one of the cartridges 4 via the tube 11 (refer to FIG. 1 to FIG. 3). Moreover, the ink outlet portion 33*a* is connected to one of the second heads 3 via the tube 12 (refer to FIGS. 1 to 3).

As shown in FIG. 5, through holes 40*a* and 41*a*, which communicate with the inlet portion 32*a* and the ink outlet portion 33*a*, respectively, are formed in the plate 34*a*. Moreover, a filter accommodating space 43*a* which communicates with the ink inlet portion 32*a* via the through hole 40*a*, and an ink outlet passage 44 which communicates with the ink outlet portion 33*a* via the through hole 41*a* are formed in the second lowest plate 35*a*. A filter 42 for removing dust and an air bubble in the ink is accommodated in the filter accommodating space 43*a*. The ink outlet passage 44 is formed by a recess formed by a half etching in the plate 34*a* and a hole communicating with the recess. Moreover, an ink reservoir 45*a* extended over almost an entire area in a longitudinal direction (main scanning direction) is formed in the third lowest plate 36*a*. The ink reservoir 45*a* communicates with both the ink outlet passage 44 and the filter accommodating space 43*a* formed in the plate 35*a* located immediately below the third lowest plate 36*a*. A plurality of ink supply holes 46*a* communicating with the ink reservoir 45*a* and the head body 31*a* are formed in the uppermost plate 37*a*.

Consequently, the ink supplied from each of the ink cartridges 4 to one of the first heads 2 via the tube 11 is infused into the ink reservoir 45*a* from the ink inlet portion 32*a* via the through hole 40*a* and the filter accommodating space 43*a*. Further, the ink in the ink reservoir 45*a* is supplied to the head body 31*a* through the ink supply holes 46*a*. On the other hand, a part of the ink in the ink reservoir 45*a* is derived from the ink outlet portion 33*a* toward one of the second heads 3 via the ink outlet passage 44.

The ink inlet portion 32*a* to which the ink is supplied from the ink cartridges 4 and the ink outlet portion 33*a* which supplies the ink to the second heads 3 are provided at both end portions in the longitudinal direction of the first reservoir unit 30*a* of each of the first heads 2. The ink supplied to one end portion of the first heads 2 is supplied to the second heads 3 from the other end portion of the first heads 2. Therefore, a flow of ink directed from the ink inlet portion 32*a* to the ink outlet portion 33*a* is generated inside the first heads 2, and an air bubble mixed in the ink hardly accumulates inside the first heads 2.

As shown in FIGS. 6 and 7, the second reservoir unit 30*b* of each of the second heads 3 is a stacked body of four plates 34*b*, 35*b*, 36*b*, and 37*b* each of which is elongated in the width direction of the paper (main scanning direction) similarly as the first reservoir unit 30*a*. However, the ink from an outside (the ink from the first reservoir 30*a* of the first heads 2) is infused into the second reservoir 30*b*, but it is not necessary to derive a part of the infused ink to the outside. Therefore, a structure of the second reservoir 30*b* differs somewhat from the structure of the first reservoir 30*a*.

An ink inlet portion 33*b* is provided at one end portion in a longitudinal direction of the uppermost plate 34*b* of the second reservoir unit 30*b*, but an ink outlet portion is not provided to the other end portion thereof. The ink inlet portion 32*b* is connected to the ink outlet portion 33*a* of the first reservoir 30*a* (refer to FIGS. 4 5) via the tube 12 (refer to FIGS. 1 to 3). The ink outlet portion 33*a* of the first reservoir unit 30*a* and the ink inlet portion 32*b* of the second reservoir unit 30*b* are provided at an end portion on the same side in the longitudinal direction thereof (main scanning direction) In other words, the ink outlet portion 33*a* and the ink inlet portion 32*b* are formed at a left-side end portion in FIG. 2 of the first reservoir unit 30*a* and the second reservoir unit 30*b* respectively. Therefore, as shown in FIG. 2, it is possible to shorten a length of the tubes 12 which connects the first heads 2 (the first reservoir unit 30*a*) and the second heads 3 (the second reservoir unit 30*b*).

As shown in FIG. 7, an internal structure of the second reservoir unit 30*b* is same as an internal structure of the first reservoir unit 30*a* except for a point that the ink outlet passage 44 (refer to FIG. 5) is not provided. Consequently, the ink supplied from the first reservoir unit 30*a* of each of the first heads 2 to the second head unit 3 via the tube 12 is infused into the ink reservoir 45*b* from the ink inlet portion 32*b* via the through hole 40*b* and the filter accommodating space 43*b*. Furthermore, the ink in the ink reservoir 45*b* is supplied through the ink supply holes 46*b* to the head body 31*b*.

Figure 8:
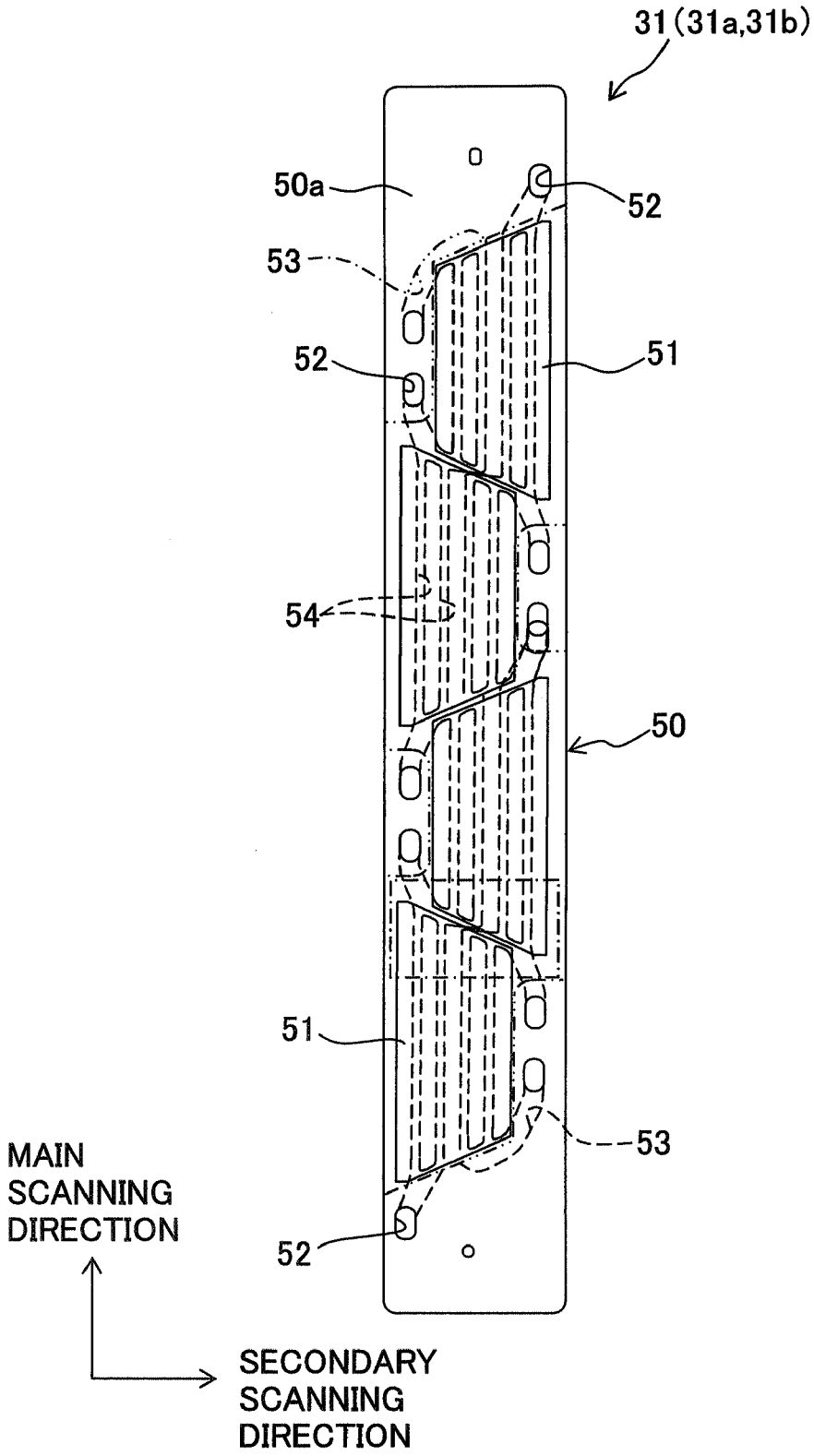
FIG. 8 is a plan view of a head main body.
Figure 9:
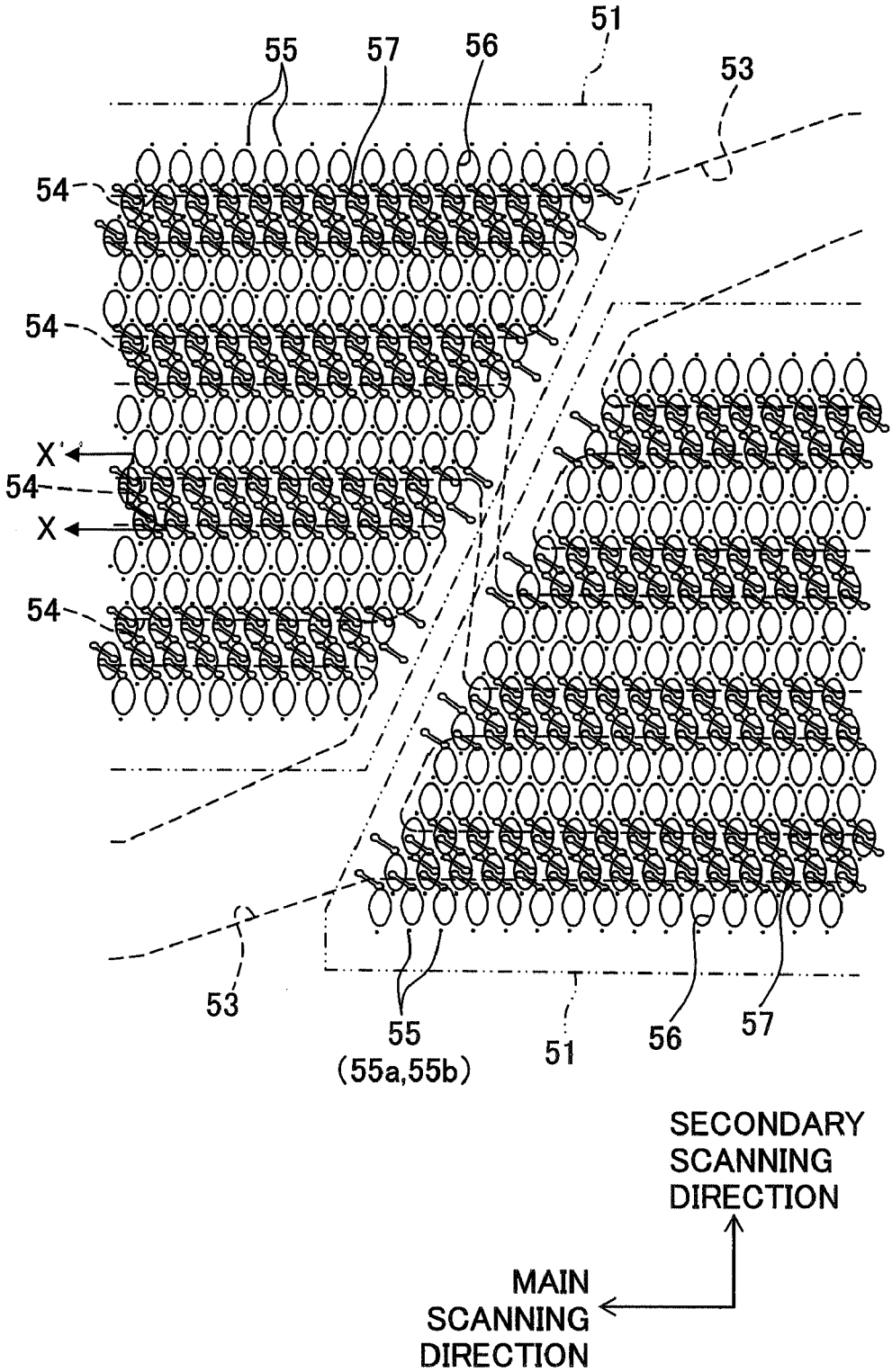
FIG. 9 is an enlarged view of an area surrounded by alternate long and short dash lines.
Figure 10:
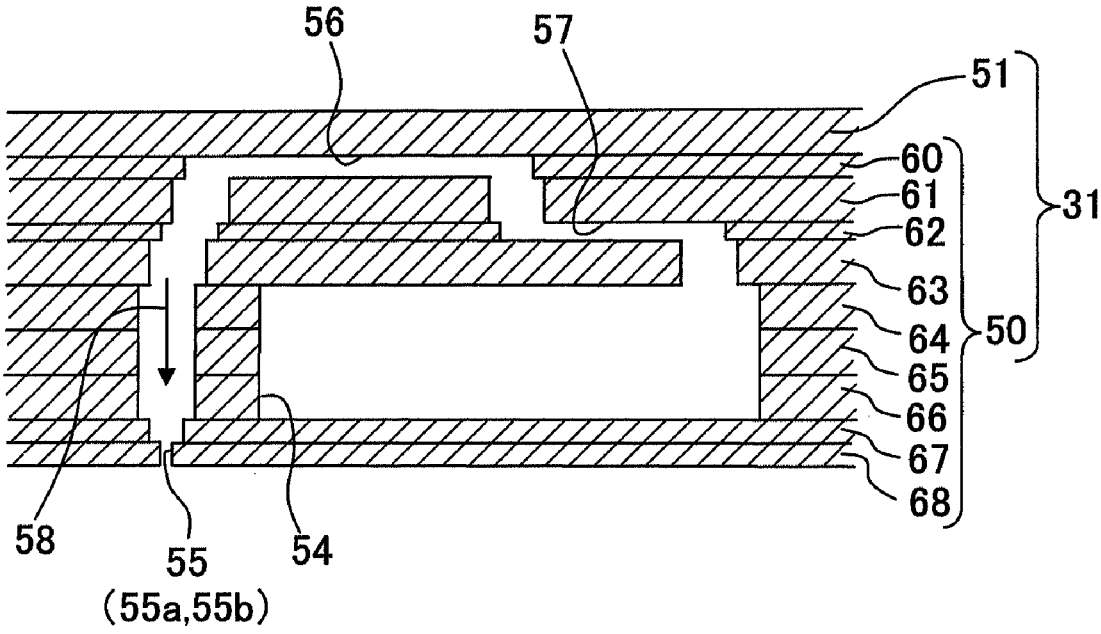
FIG. 10 is a partial cross-sectional view along a line X-X shown in FIG. 9.
Figure 11A:
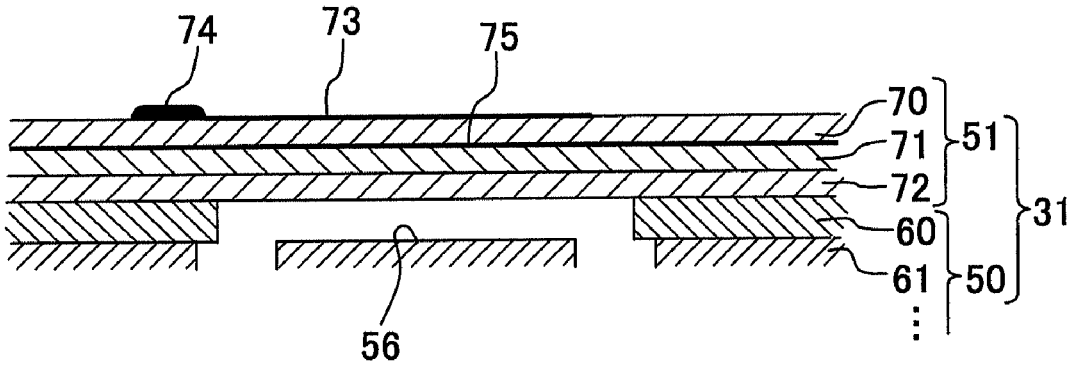
FIG. 11A is an enlarged cross-sectional view of an actuator unit.
Figure 11B:
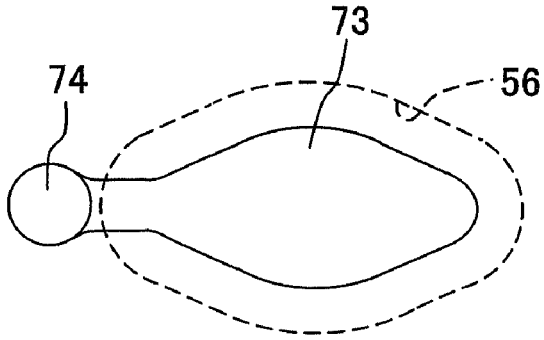
FIG. 11B is a plan view of an individual electrode shown in FIG. 11A.

Next, the head body will be described below. A structure of the head body 31*a* of the first heads 2 and a structure of the head body 31*b* of the second heads 3 are same, and in the following description, when the head body 31*a* and the head body 31*b* are not distinguished, the head body 31*a* and the head body 31*b* are called as a head body 31. FIG. 8 is a plan view of the head body 31. FIG. 9 is an enlarged view of an area surrounded by alternate long and short dash lines in FIG. 8. For convenience of description, in FIG. 9, elements, which should be indicated by broken lines, are indicated by continuous lines. Specifically, the nozzles 55, an apertures 57, and pressure chambers 56 at a lower side of an actuator unit 51 are indicated by continuous lines. FIG. 10 is a partial cross-sectional view taken along a X-X line shown in FIG. 9. FIG. 11A is an enlarged cross-sectional view of the actuator unit 51, and FIG. 11B is a plan view of an individual electrode 73 shown in FIG. 11A.

As shown in FIG. 8, the head body 31 includes a channel unit 50 in which ink channels including the nozzles 55 and the pressure chamber 56 are formed, and four actuator units 51 which are fixed to an upper surface 50*a* (a frontward side of a paper surface in FIG. 8) of the channel unit 50, and which apply a pressure to the ink in the pressure chamber 56.

A shape of the channel unit 50 is rectangular parallelepiped, and in a plan view, the channel unit 50 has almost a same shape as the reservoir unit 30*a* (30*b*). A plurality of ink supply ports 52 (ten ports in the embodiment) corresponding to the ink supply holes 46*a* (46*b*) of the reservoir unit 30*a* (30*b*) (refer to FIG. 5 and FIG. 7) is formed in one surface 50*a* (a frontward side of the paper surface in FIG. 8). Manifold channels 53 communicating with the ink supply ports 52 and secondary (sub) manifold channels 54 branched from the manifold channels 53 are formed in the channel unit 50. Moreover, in a rear surface (a rearward side of the paper surface in FIG. 8, a liquid droplet jetting surface) of the channel unit 50 on an opposite side of the upper surface 50*a*, the plurality of nozzles 55 is arranged in a matrix form along two directions namely the main scanning direction and a direction intersecting the main scanning direction as shown in FIGS. 9 and 10. Moreover, the plurality of pressure chambers 56 is also arranged in the matrix form similarly as the nozzles 55 on a fixed surface of each of the actuators 51 in the channel unit 50.

As shown in FIG. 10, the channel unit 50 includes nine metallic plates such as stainless steel plates namely, a cavity plate 60, a base plate 61, an aperture plate 62, a supply plate 63, manifold plates 64, 65, and 66, a cover plate 67, and a nozzle plate 68, and these plates are stacked in this order from the top.

A plurality of through holes corresponding to the ink supply ports 52 (refer to FIG. 8) and a plurality of through holes, each being defined as a rhombus shape, corresponding to the pressure chambers 56 are formed in the cavity plate 60. For each of the pressure chambers 56, a communicating hole communicating with one of the pressure chambers 56 and one of the aperture 57 and a communicating hole communicating with one of the pressure chambers 56 and one of the nozzles 55 are formed in the base plate 61. Furthermore, communicating holes (not shown in the diagram) each communicating with one of the ink supply ports 52 and one of the manifold channels 53 are formed in the base plate 61.

In the aperture plate 62, for each of the pressure chambers 56, a through hole which is to be one of the apertures 57 and a communicating hole communicating with one of the pressure chambers 56 and one of the nozzles 55 are formed. Furthermore, a plurality of communicating holes (not shown in the diagram) each communicating with one of the ink supply ports 52 and one of the manifold channels 53 are formed in the aperture plate 62. In the supply plate 63, for each of the pressure chamber 56, a communicating hole communicating with one of the apertures 57 and one of the secondary (sub) manifold channels 54 and a communicating hole communicating with one of the pressure chamber 56 and one of the nozzles 55 are formed Furthermore, a plurality of communicating holes (not shown in the diagram) each communicating with one of the ink supply ports 52 and one of the manifold channels 53 is formed in the supply plate 63.

For each of the pressure chambers 56, a communicating hole communicating with one of the pressure chambers 56 and one of the nozzles 55, and a through hole which is to be one of the manifold channels 53 and one of the secondary (sub) manifold channels 54 are formed in the manifold plates 64, 65, and 66. The manifold channels 53 and the secondary manifold channels 54 are formed when the manifold plates 64 to 66 are stacked such that the through holes formed in the plates are connected with each other. A plurality of communicating holes each communicating with one of the pressure chambers 56 and one of the nozzles 55 is formed in the cover plate 67. For each of the pressure chambers 56, a hole corresponding to one of the nozzles 55 (the first nozzle 55*a* in the first head 2 and the second nozzle 55*b* in the second head 3) is formed in the nozzle plate 68.

These plates 60 to 68 are stacked while the plates 60 to 68 are positioned with each other. At this time, the manifold channel 53, the secondary manifold channel 54, and a plurality of individual ink channels 58 each ranging from an exit of the secondary manifold channel 54 to one of the nozzles 55 via one of the pressure chambers 56 are formed.

Consequently, the ink supplied into the channel unit 50 from the reservoir unit 30 (the first reservoir unit 30*a* and the second reservoir unit 30*b*) via the ink supply ports 52 is distributed from the manifold channels 53 to the secondary (sub) manifold channels 54. Furthermore, the ink in the secondary manifold channels 54 flows to each of the individual ink channels 58, and in each of the individual ink channels 58, the ink reaches the nozzles 55 (the first nozzles 55*a* or the second nozzles 55*b*) via the apertures 57 and the pressure chambers 56 which function as throttle channels.

Next, the actuator units 51 will be described below. As shown in FIG. 8, the four actuator units 51 are trapezoidal shaped in a plan view, and are arranged in a zigzag form so as not to overlap with the ink supply ports 52. Furthermore, out of four sides of each of the actuator units 51, two parallel sides facing mutually are arranged to be aligned in a longitudinal direction of the channel unit 50. Oblique sides of the two adjacent actuator units 51 mutually overlap in a direction of width of the channel unit 50 (secondary scanning direction).

As shown in FIG. 11A, each of the actuator units 51 includes three piezoelectric sheets 70, 71, and 72 made of a ferroelectric lead zirconate titanate (PZT) ceramics material. The individual electrodes 73 are formed on an upper surface of the uppermost piezoelectric sheet 70, at a position overlapping with the pressure chambers 56, respectively. A common electrode 75, which covers the surface of the piezoelectric sheets 70, 71 entirely, is arranged between the uppermost piezoelectric sheet 70 and the piezoelectric sheet 71 which is stacked below the uppermost piezoelectric sheet 70. As shown in FIG. 11B, each of the individual electrodes 73 is substantially rhombus shaped in a plan view, similar to the pressure chambers 56. One of the acute-angled corner portions of the rhombus shaped individual electrode 73 is extended outward, and at a front end thereof, a circular-shaped land 74 which is electrically connected to the one of the individual electrodes 73 is provided.

The common electrode 75 which covers all of the pressure chambers 56 is kept at the ground electric potential. Whereas, since a terminal of each of the lands 74 and a driver IC 76 (refer to FIG. 12) are connected via a Flexible Printed Circuit (FPC) not shown in the diagram, the driver IC 76 is capable of controlling selectively an electric potential of each of the individual electrodes 73.

Here, a method of driving of the actuator units 51 will be described. The piezoelectric sheet 70 is polarized in a thickness direction thereof. When an electric potential different from an electric potential of the common electrode 75 is applied to one of the individual electrodes 70, an electric field is generated in the piezoelectric sheet 70, in the polarization direction thereof. At this time, a portion of the piezoelectric sheet 70 in which the electric field is generated acts as an active portion, and the active portion is deformed due to a piezoelectric effect. Moreover, as shown in FIG. 11A, the piezoelectric sheets 70, 71, and 72 are fixed to a surface of a beam portion, of the cavity plate 60, which divides the pressure chambers 56. Since there is a difference in deforming in a planar direction between the portion of the piezoelectric sheet 70 to which the electric field is applied, and another portion of the piezoelectric sheets 71 and 72 under the piezoelectric sheet 70, all the piezoelectric sheets 70, 71, and 72 are deformed to form a projection toward the pressure chambers 56 (unimorph deformation). Accordingly, a pressure (jetting energy) is applied to the ink in the pressure chambers 56, and ink droplets are jetted from the nozzles 55.

Next, an electrical structure of the printer 1 will be described below with reference to a block diagram in FIG. 12, focusing a control unit 7. The control unit 7 shown in FIG. 12 includes a Central Processing Unit (CPU), a Read Only Memory (ROM) in which various computer programs and data for controlling an overall operation of the printer 1 are stored, and a Random Access Memory (RAM) which temporarily stores data etc. to be processed by the CPU.

Moreover, as shown in FIG. 12, the control unit 7 includes a printing control section 80 which controls printing on the printing paper P, and a maintenance control section 81 which controls a maintenance process for restoring a jetting function of the first nozzles 55*a* and the second nozzles 55*b*. Functions of the printing control section 80 and the maintenance control section 81 are realized when the CPU executes various control programs (various computer programs for control) stored in the ROM.

The printing control section 80 controls the driver IC 76 of the first head 2 and the second head 3, and the drive motors 82, 83, and 84 to perform printing of an image etc. on the printing paper P based on data input from an input unit (input device) 90 such as a PC (Personal Computer). The drive motors 82, 83, and 84 control the feeding roller 13, the main roller 14, the spur roller 15, respectively, the rollers transporting the printing paper, and being included in the paper transporting mechanism 5.

The maintenance control section 81 controls the suction pump 19 and the cap driving mechanism 217 (refer to FIG. 12) which drives the first cap 17 and the second cap 18 (refer to FIGS. 2 and 3) to suck and discharge the ink from the nozzles 55*a* and 55*b* of the first head 2 and the second head 3 via the first cap 17 and the second cap 18 (suction purge). Here, the maintenance control section 81 is capable of controlling to carry out the suction purge for both the first head 2 and the second head 3, simultaneously. Moreover, it is also possible to control to carry out the suction purge for any one of the first head 2 and the second head 3. In the following cases, the suction purge may be carried out only for the one head, but the suction purge may not be carried out for the other head. For example, a case in which a jetting defect occurs only in the nozzles 55 of the one head; and a case in which the one-sided printing is carried out on a surface of the printing paper P by the one head, but the other head is not used for some time.

The following effect can be achieved by such printer 1 of the embodiment having the abovementioned structure. As shown in FIGS. 1 and 2, the second head 3 is connected to the ink cartridges 4 via the first head 2 in which the position of nozzles 55 (liquid droplet jetting surface) is low, and the ink is supplied to the second head 3 via the first head 2. In this manner, when one ink cartridge and two heads namely the first head 2 and the second head 3 are connected serially, it is possible to shorten a total length of the tube (total length of the tubes 11 and 12), as compared to a case in which the ink cartridge 4 and the two heads namely the first head 2 and the second head 3 are connected by a separate tube (parallel connection). Therefore, it is possible to reduce a cost of the tubes, and moreover, it is possible suppress the thickening of ink inside the tubes and the entry of air bubbles into the tubes.

Moreover, both the first head 2 and the second head 3 of the embodiment are fixed line heads. In other words, the first head 2 (the second head 3) has the nozzle rows each including the plurality of nozzles 55 arranged along one direction (main scanning direction), and jets the droplets of ink while the first head 2 (the second head 3) is positioned and fixed at a predetermined position. Such fixed line head may be affected substantially when there is thickening of ink inside the tube and when an air bubble enters into the tube, as compared to a serial head which jets liquid droplets while reciprocating along the width direction of paper.

In other words, unlike the serial head which is movable in the width direction of paper, in the fixed line head, when a jetting defect has occurred in some of the nozzles 55 due to the thickening of the ink inside the tubes or the entry of an air bubble into the tubes, it is not possible to supplement the nozzles 55 in which the jetting defect has occurred, by other normal nozzles 55. Therefore, for eliminating the jetting defect of the nozzles 55, the maintenance mechanism 6 performs the suction purge. However, since the number of the nozzles in the line head is tend to be substantially large as compared to the number of nozzles in the serial head, an amount of ink which is discharged from the nozzles 55 at the time of the suction purge tends to be extremely large. Consequently, in the printer 1 having the fixed line head, suppressing the thickening of the ink and the entry of the air bubble by shortening the total length of the tube has a substantial significance from a point that it is possible to reduce the amount of ink discharged at the time of the suction purge.

When the two heads namely the first head 2 and the second head 3 having a different height position of the nozzles 55 (liquid droplet jetting surface) are connected serially, there is a fear that following problems may arise. When in the second head 3 in which the nozzle position is higher than the first head, a meniscus inside the second nozzles 55*b* breaks due to a disturbance or the like, an atmospheric pressure acts on the ink inside the second head 3, and the ink flows reversely from the second head 3 to the first head 2 in which the nozzle position is lower via the tube 2.

However, in the printer 1 of the embodiment, the first head 2 in which the nozzle position is lower than the nozzle position of the second head 3, is positioned near side of the ink cartridge 4 (upstream side in a direction of supply of ink), and further, the ink cartridge 4 is at a position even lower than the first nozzles 55*a* of the first head 2. Therefore, the ink which has flowed reversely from the second head 3 to the first head 2 passes through the ink reservoir 45*a* of the first reservoir unit 30*a* shown in FIG. 5, and is escaped through the ink infusing portion 32*a* to the ink cartridge 4. Consequently, no substantial pressure is exerted on the ink inside the first nozzles 55*a* of the first head 2, and a meniscus in the first nozzles 55*a* is prevented from being broken. In other words, there is no fear of leaking out of a large amount of ink from both the first head 2 and the second head 3.

Next, modified embodiments in which various modifications are made in the embodiment will be described below. Same reference numerals are assigned to components which are similar as in the embodiment, and repeated description of such components is omitted.

First Modified Embodiment

In the embodiment, the ink cartridge 4 which is detachably mounted on the holder 10 and the first head 2 are connected by the tube 11 (refer to FIG. 1). However, as in a printer 1A shown in FIG. 13, four sub tanks 91 (buffer tanks) may be arranged, between the first head 2 and the ink cartridge 4 which is detachable, at a position lower than the upper surface of the first head 2 (liquid droplet jetting surface on which the first nozzles 55*a* are arranged). Each of the sub tanks 91 is connected to one of the ink cartridges 4 by the tube 11, and is connected to the first head 2 by the tube 11. In other words, the sub tanks 91 supply the ink to the first head 2 upon storing once the ink supplied from the ink cartridge 4. In this case, the sub tank 91 corresponds to a part of a liquid storage container of the present invention which stores the ink to be supplied to the first head 2 and the second head 3. In this case, since the sub tank 91 is provided between the ink cartridge (main tank) 4 and the first head 2, it is possible to avoid an air bubble etc. mixed at the time of replacing the ink cartridge 4 from reaching up to the first head 2.

Figure 13:
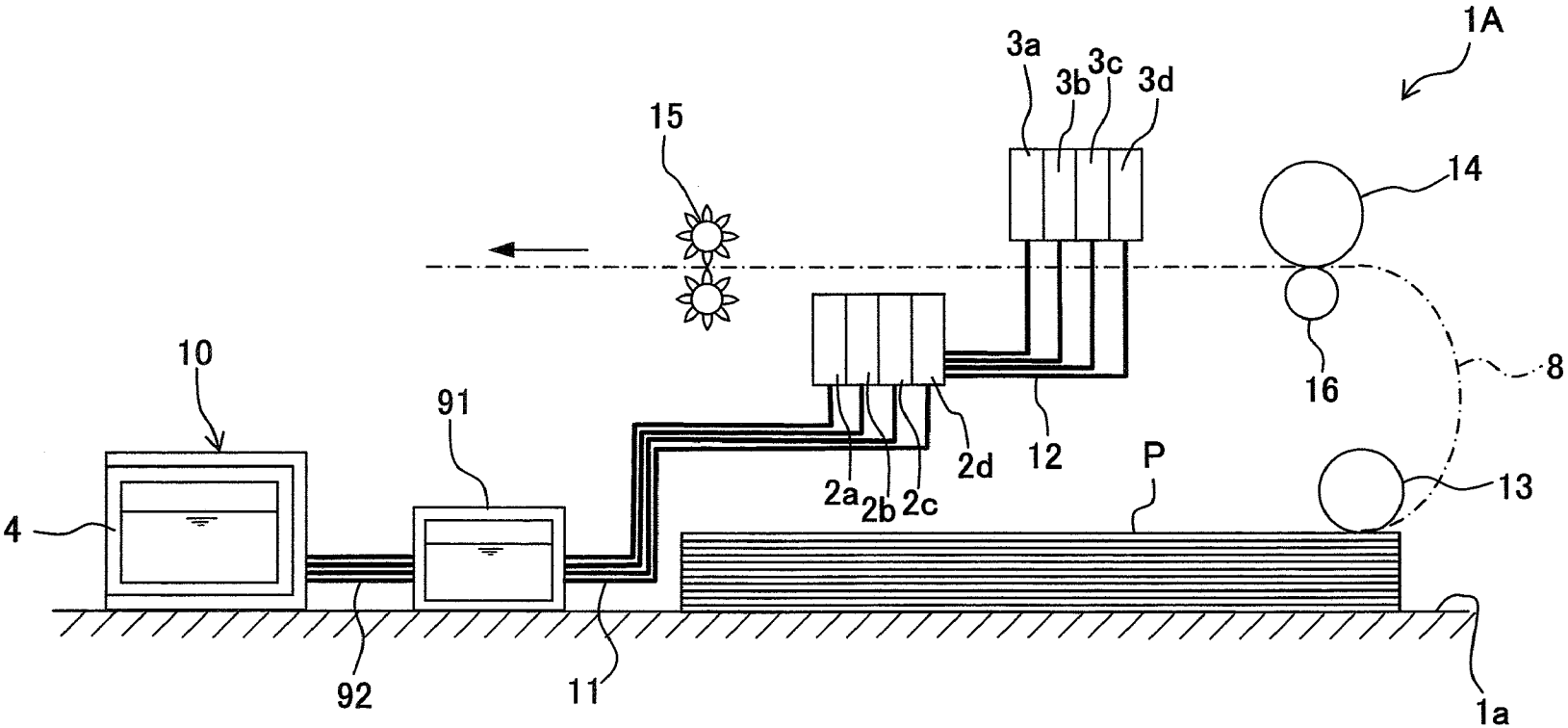
FIG. 13 is a side view showing a schematic structure of a printer according to a first modified embodiment.

In FIG. 13, the sub tank 91 and the ink cartridge 4 are arranged at the same height position (the bottom surface 1*a* of the printer body). However, the ink cartridge 4 may be arranged at a position lower than the sub tank 91. The ink cartridge 4 may be arranged at a position higher than the sub tank 91. In that case, when the ink can flow between the ink cartridge 4 and the sub tank 91 all the time, and when a water head pressure of the ink cartridge 4 is acting (is exerted) all the time on the sub tank 9, the ink flowed reversely from the second head 3 hardly escapes to the sub tank 91.

Therefore, in a case of arranging the ink cartridge 4 at a position higher than the sub tank 91, in the stand-by state, it is preferable that the flow of the ink between the ink cartridge 4 and the sub tank 9 is disrupted (cut-off), and that the water head pressure of the ink cartridge 4 is not exerted to the sub tank 91. And, it is preferable that the ink is supplied from the ink cartridge 4 to the sub tank 91 only when the amount of ink inside the sub tank 91 has become small. As such structure, it is possible to adopt a structure of the ink cartridge and the buffer tank which the inventors of the present patent application have proposed in U.S. Pat. No. 178908 (Japanese Patent Application Laid-open Publication No. 2005-103758). In this modified embodiment, the volume of the ink cartridge and the volume of the sub tank can be determined independently. For example, the volume of the ink cartridge may be larger than that of the sub tank.

Second Modified Embodiment

The printer 1 of the embodiment includes the first head 2 and the second head 3 arranged on both sides sandwiching the paper transporting path 8, such that it is possible to print simultaneously on both surfaces of the printing paper P. However, the present invention is also applicable to a printer for single face printing (single-sided printing). In that case, it is possible to perform a high-speed printing by using two heads.

Figure 14:
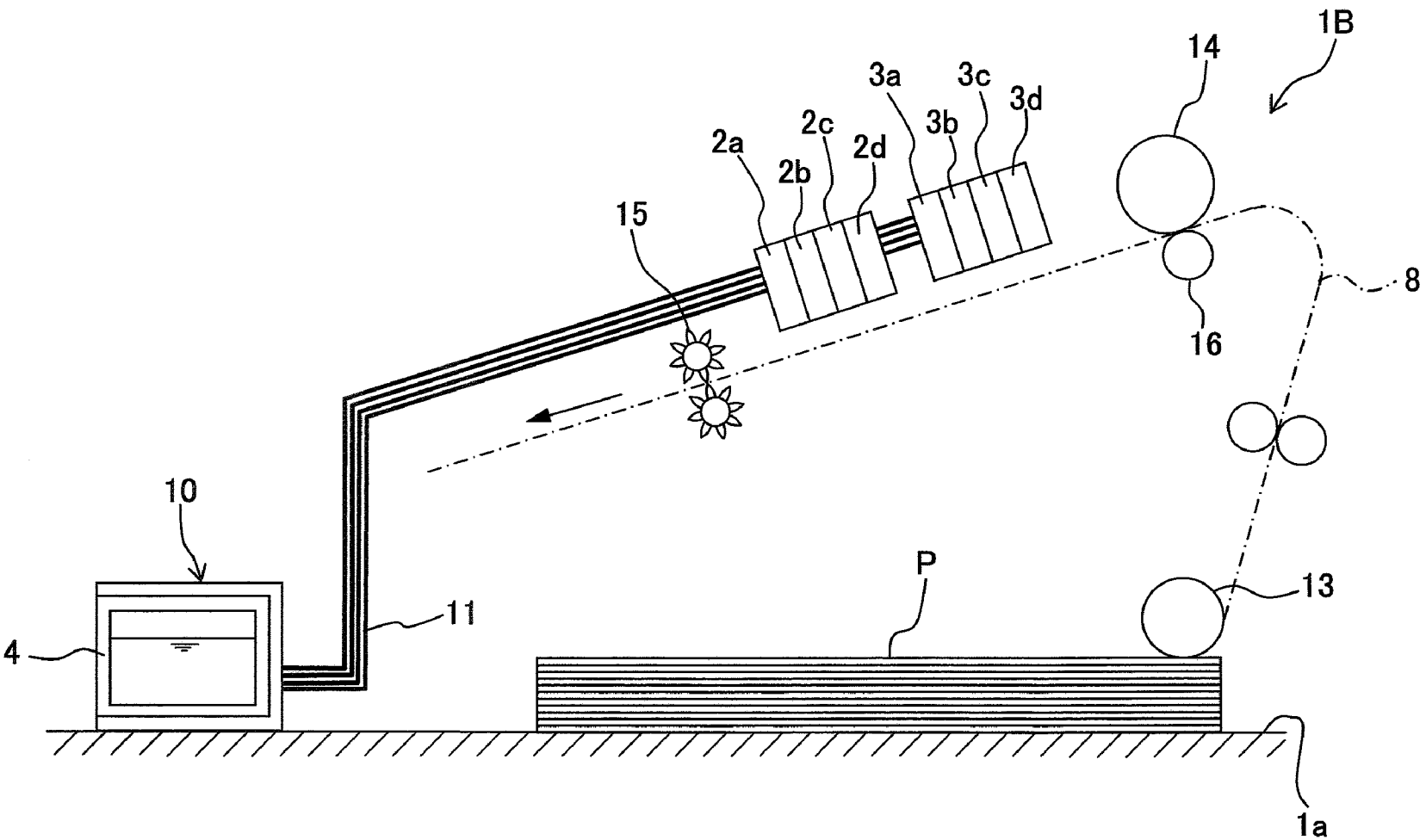
FIG. 14 is a side view showing a schematic structure of a printer according to a second modified embodiment.

In other words, as shown in FIG. 14, in a printer 1B of a second modified embodiment, the paper transporting path 8 of the printing paper P which is transported by the main roller 14 and the spur roller 15, is inclined to be directed downwardly toward a downstream side of the transporting direction. The first head 2 and the second head 3 are arranged, in this order from a lower side, at an upper side of the inclined paper transporting path 8. In the printer 1B, a lower surface of the first head 2 and a lower surface of the second head 3 are liquid droplet jetting surfaces on which the nozzles 55 are arranged.

Moreover, the first head 2 is connected to the ink cartridge 4 arranged at a lower side of the lower surfaces of the first head 2 and the second head 3 (liquid droplet jetting surface on which the nozzles are arranged), via the tubes 11. Furthermore, the first head 2 and the second head 3 are also connected via the tubes 12. In other words, the second head 3 arranged at the upper side of the paper transporting path 8 is connected to the ink cartridge 4 via the first head 2 arranged at the lower side of the paper transporting path 8.

In the printer 1B, the liquid droplets are jetted from the two heads namely the first head 2 and the second head 3 arranged along the direction of transporting of paper. At this time, an image etc. is printed only on an upper surface of the printing paper P which is transported. Even in such printer 1B for single face printing, at the time of connecting the two heads having a different height position of the nozzles 55 namely, the first head 2 and the second head 3 serially, it is possible to shorten the total length of the tubes 11 and 12 as compared to a case of connecting the first head 2 and the second head 3 in parallel. Moreover, the ink, which flows reversely from the second head 3 to the first head 2, escapes from the first head 2 to the ink cartridge 4, when the meniscus of the nozzles 55*b* in the second head 3 positioned on the upper side is broken. Therefore, the meniscus in the first nozzle 55*a* of the first head 2 is prevented from being broken.

In the embodiment, both the first head 2 and the second head 3 having different nozzle positions are fixed line heads. However, even in a case in which one of the first and second heads 2, 3, or both of the first and second heads 2, 3 may be serial heads jetting liquid droplets on to a printing paper while reciprocating in one direction. In other words, the printer according to the present invention may includes a head holder on which the head is mounted, and a head driving mechanism which makes reciprocate the head holder in a predetermined direction (main scanning direction, a direction orthogonal to the direction of transporting of paper). Even in this case, a similar effect can be achieved by applying the present invention.

In the embodiment, the two heads of one ink cartridge are connected serially. However, three or more heads in which the height position of the nozzles differs mutually may be connected serially to one ink cartridge. In this case, the plurality of heads are connected serially such that, the head having a lower position of the height of the nozzles is arranged at a side toward the ink cartridge (upstream side in direction of ink supply).

The embodiment and the modified embodiments described above are examples in which the present invention is applied to an ink-jet printer which records an image etc. by jetting an ink on to a recording paper. However, the application of the present invention is not restricted to such printers. In other words, the present invention is applicable to various liquid droplet jetting apparatuses which jet liquids of various types other than ink, on an object according to the intended use. For example, the present invention is also applicable to an apparatus which forms a wiring pattern by transferring on a substrate an electro conductive liquid in which metallic nanoparticles are dispersed, an apparatus which manufactures a DNA chip by using a solution in which a DNA is dispersed, an apparatus which manufactures a display panel by using a solution in which an electro luminescence material such as an organic compound is dispersed, and an apparatus which manufactures a color filter for a liquid-crystal display by using a liquid in which pigments for color filter are dispersed.

What is claimed is:

1. A liquid droplet jetting apparatus which jets droplets of a liquid onto an object, the apparatus comprising:

a first head in which a first nozzle, through which a first droplet of the liquid is jetted, is formed;

a second head in which a second nozzle, through which a second droplet of the liquid is jetted and which is located at a higher position than the first nozzle, is formed;

a liquid tank which supplies the liquid to the first and second heads and which is located at a lower position than the first and second nozzles; and a plurality of tubes via which the first head, the second head and the liquid tank are connected;

wherein the first head is connected to an end of one tube of the tubes, and the liquid tank is connected to the other end of the one tube;

wherein the second head is connected to the first head via an another tube which is different from the one tube such that the second head is connected to the liquid tank via the first head;

wherein the first head is provided with the ink outlet portion which is connected to the another tube and the second head is provided with the ink inlet portion which is connected to the another tube; and wherein the ink inlet portion is located at a higher position than the ink outlet portion such that a pressure head of the liquid at the ink inlet portion is higher than that at the ink outlet portion.

2. The liquid droplet jetting apparatus according to claim 1;

wherein the liquid tank is connected to one end portion of the first head; and wherein the second head is connected to the other end portion of the first head.

3. The liquid droplet jetting apparatus according to claim 1;

wherein each of the first nozzle and the second nozzle includes a plurality of nozzles, and each of the first and second head is a fixed-type line head in which a nozzle row including the plurality of nozzles arranged in a predetermined direction is formed, and which jets the droplets of the liquid while the fixed-type line head is positioned and fixed at a predetermined position.

4. The liquid droplet jetting apparatus according to claim 1, further comprising a transporting mechanism which transports the object, between the first head and the second head;

wherein the first droplet and the second droplet are jetted onto a front surface and a rear surface of the object, respectively, which is transported by the transporting mechanism.

5. The liquid droplet jetting apparatus according to claim 1;

wherein the first head is arranged such that the first nozzle is open upwardly, and the second head is arranged such that the second nozzle is open downwardly; and wherein the liquid droplet jetting apparatus further includes a transporting mechanism which transports the object along a transporting path which is located at a position above the first head, and at a position below the second head.

6. The liquid droplet jetting apparatus according to claim 5;

wherein the first head and the second head are arranged to face with each other.

7. The liquid droplet jetting apparatus according to claim 1, further comprising:

a purge mechanism including a first cap which covers the first nozzle of the first head;

a second cap which covers the second nozzle of the second head;

a cap driving mechanism which drives the first and second caps to move the first and second caps detachably toward a first nozzle surface in which the first nozzle is formed and a second nozzle surface in which the second nozzle is formed, respectively; and a suction mechanism which is connected to the first cap and the second cap and which performs suction for a space defined by the first cap and the first nozzle surface and a space defined by the second cap and the second nozzle surface.

8. The liquid droplet jetting apparatus according to claim 7;

wherein the suction mechanism includes a suction pump and a switch which switches a connection point of the suction pump between the space defined by the first cap and the first nozzle surface and the space defined by the second cap and the second nozzle surface.

9. The liquid droplet jetting apparatus according to claim 1;

wherein the liquid tank includes a main tank which stores the liquid to be supplied to the first head and the second head, and a sub tank which is arranged between the main tank and the first head and which stores temporarily the liquid to be supplied to the first head and the second head.

10. The liquid droplet jetting apparatus according to claim 9;

wherein the sub tank is arranged at a position higher than the main tank.

11. The liquid droplet jetting apparatus according to claim 1;

wherein one of the first head and the second head is a serial head which jets the respective first or second droplet of the liquid onto the object while reciprocating in a predetermined direction.

12. The liquid droplet jetting apparatus according to claim 1;

wherein the liquid is an ink, and each of the first and second head is a piezoelectric type ink-jet head which jets a droplet of the ink onto the object.

13. A liquid droplet jetting apparatus which jets droplets of a liquid onto an object, the apparatus comprising:

a first head in which a first nozzle, through which a first droplet of the liquid is jetted, is formed;

a second head in which a second nozzle, through which a second droplet of the liquid is jetted and which is located at a higher position than the first nozzle, is formed;

a liquid tank which supplies the liquid to the first and second heads and which is located at a lower position than the first and second nozzles; and a plurality of tubes via which the first head, the second head and the liquid tank are connected;

wherein the first head is connected to an end of one tube of the tubes, and the liquid tank is connected to the other end of the one tube;

wherein the second head is connected to the first head via an another tube which is different from the one tube such that the second head is connected to the liquid tank via the first head;

wherein the first head and the second head are arranged such that the first nozzle and the second nozzle are open downwardly; and wherein the liquid droplet jetting apparatus further includes a transporting mechanism which transports the object along a transporting path which is inclined from a position below the first head to another position below the second head.

* * * * *